United States Patent [19]

Nakamura

[11] Patent Number: 4,613,236

[45] Date of Patent: Sep. 23, 1986

[54] DOUBLE PENDULUM CLOCK

[75] Inventor: Norihiko Nakamura, Tokyo, Japan

[73] Assignee: Rhythm Watch Co., Ltd., Tokyo, Japan

[21] Appl. No.: 637,525

[22] Filed: Aug. 3, 1984

[30] Foreign Application Priority Data

| | | | |
|---|---|---|---|
| Aug. 11, 1983 | [JP] | Japan | 58-147258 |
| Aug. 17, 1983 | [JP] | Japan | 58-126962[U] |
| Aug. 17, 1983 | [JP] | Japan | 58-150057 |
| Aug. 17, 1983 | [JP] | Japan | 58-150058 |

[51] Int. Cl.[4] ..... G04B 17/02

[52] U.S. Cl. ..... 368/165; 368/179

[58] Field of Search ..... 368/179, 165; 40/426, 40/439

[56] References Cited

U.S. PATENT DOCUMENTS

| | | | |
|---|---|---|---|
| 2,185,805 | 1/1940 | Feiner | 368/179 |
| 4,395,137 | 7/1985 | Wiley | 368/179 |

FOREIGN PATENT DOCUMENTS

| | | | |
|---|---|---|---|
| 415517 | 6/1925 | Fed. Rep. of Germany | 368/179 |
| 114788 | 8/1983 | Japan . | |
| 193288 | 12/1983 | Japan . | |
| 49989 | 4/1984 | Japan . | |
| 109990 | 7/1984 | Japan . | |
| 369705 | 3/1932 | United Kingdom | 368/179 |
| 2017982 | 10/1979 | United Kingdom | 368/179 |

*Primary Examiner*—Bernard Roskoski

*Attorney, Agent, or Firm*—Koda & Androlia

[57] ABSTRACT

A double pendulum clock swingingly hanging and supporting two different pendulums including a first pendulum rod swingingly pivoted on a clock body and connected to a first pendulum, a drive magnet attached to the first pendulum rod, a drive coil provided on the clock body to drive the first pendulum by means of electromagnetic coupling with the drive magnet, a second pendulum rod swingingly pivoted on the clock body and connected to a second pendulum, and linking magnets provided at positions facing both of the first pendulum rod and the second pendulum rod and swinging the second pendulum rod in accordance with the swing of the first pendulum rod by means of mutual magnetic force.

2 Claims, 21 Drawing Figures

DOUBLE PENDULUM CLOCK

BACKGROUND OF THE INVENTION

1. Field of the Invention

This invention relates to a double pendulum clock, and more particularly to an improvement of the double pendulum clock which swingingly hangs and supports two different pendulums on its body and can separately swing these two pendulums.

2. Description of the Prior Art

Despite the electronization in timepieces in recent years, consumers still like classic pendulum clocks for table or wall clocks and the pendulum clocks with pendulums or decorated pendulums are widely used not only for a time counter but also for a kind of interior decoration.

As one kind of the pendulum clock this inventor previously proposed a double pendulum clock, having two pendulums, swings of which can provide a variety of designs on its outer look.

The conventional double pendulum clock, however, carries a complicated mechanism to swing two pendulums, and this makes its clock movement larger in size. Especially, the driving mechanism increases the thickness so that the appearance of the clock must be affected to a large extent.

In recent years the double pendulum clock is worked by an electromagnetic drive in ordinary cases in which the pendulums are both driven by electromagnetic coupling force between a driving coil provided on the clock body and a driving magnet fixed to the pendulum rod. In the prior art devices there are required two pairs of such electromagnetic driving mechanisms which make the apparatus complicated and large in size.

Furthermore, in the double pendulum clock in the recent years, the two pendulum rods are designed to swing in the vacant space of the clock body so that it becomes advantages for the pendulum rods to be arranged closely to each other in order to design the clock thinner. On the other hand, such close arrangement of two pendulum rods lowers the stability along the axis direction in the supporting member and results in collision of the two pendulums in the actual use, which makes rough swinging action of the pendulums and stops their movement.

SUMMARY OF THE INVENTION

Accordingly, it is an object of the present invention to provide a double pendulum clock which has a simple swing drive mechanism providing firm swings of the two pendulums as well as an arrangement which is small and thin.

In keeping with the principles of the present invention, the object is accomplished with a double pendulum clock in which the normal electromagnetic driving operation is performed to only one of the double pendulums by the combination between a driving coil and a driving magnet and to the other pendulum by the driving operation is done by mutual magnetic force of linking magnets provided on each of the double pendulums, whereby the electromagnetic drive mechanism utilizing the drive coil provided on the clock body can be composed in a simple manner and the clock body can be totally designed to be small and thin in size.

DESCRIPTION OF THE PREFERRED EMBODIMENTS

Referring more particularly to the drawings, the preferred embodiments according to the present invention will be hereinafter described.

THE FIRST EMBODIMENT

Figure 1:
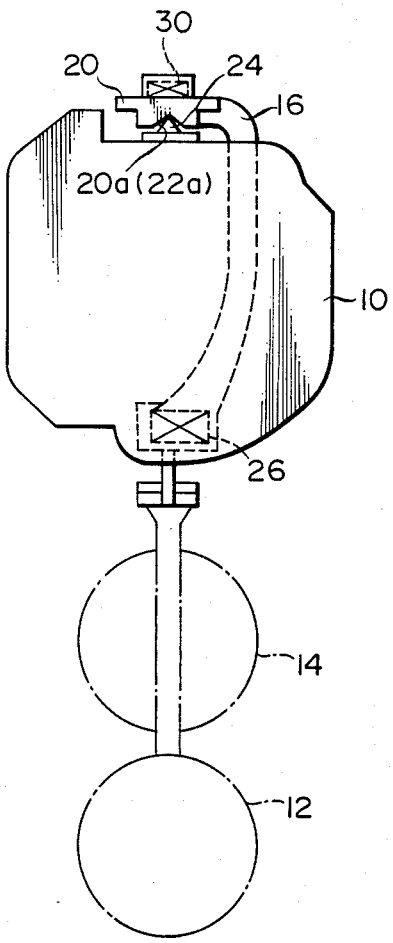
FIG. 1 is a rear elevation of a principal portion showing a preferred embodiment of a double pendulum clock in accordance with the teachings of the present invention.
Figure 2:
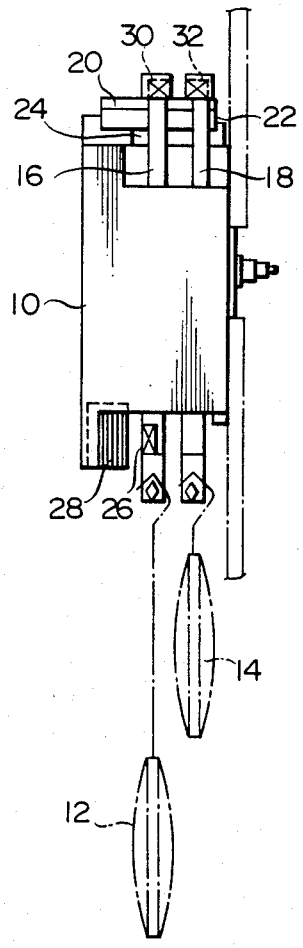
FIG. 2 is a side view of FIG. 1.

In FIGS. 1 and 2 shown therein are the first preferred embodiment of a double pendulum clock in accordance with the teachings of the present invention. A clock body 10 consisting of a crystal clock and the double pendulums are driven as ornamental pendulums quite separately from the time counting action of the clock body.

In this embodiment, the double pendulums consist of the first pendulum 12 and the second pendulum 14 with different length and are respectively coupled to the first pendulum rod 16 and the second pendulum rod 18, each of which is swingably supported by the clock body 10. The pendulum rods 16 and 18 are fixingly provided with supporting portions 20 and 22 on their top ends respectively and the V-shaped grooves 20*a* and 22*a* are made on the lower surface of the supporting portions 20 and 22. The engagement of the V-shape grooves 20*a* and 22*a* with a knife-edge 24 fixed on the clock body 10 swingingly supports both of the pendulum rods 16 and 18 on the clock body 10.

In order to drive and swing the above mentioned first pendulum rod 16 at a predetermined cycle a drive magnet 26 is attached to the first pendulum rod 16, and a driving coil 28 is fixed at a predetermined position on the clock body 10 so that the driving coil 28 can face the above mentioned drive magnet 26. Therefore, the magnet coupling between the drive magnet 26 and the drive coil 28 drives and swings the first pendulum rod 16 of the first pendulum 12.

The present invention is characterized in that the electromagnetic driving action between the drive magnet 26 and the drive coil 28 is performed with the first pendulum rod 16 or the first pendulum 12, and the drive coil 28 fixed on the clock body 10 does not contribute to the movement of the second pendulum rod 18 or the second pendulum 14. The movement of the second pendulum rod 18 is linked to the movement of the first pendulum rod 16.

In other words, a linking magnet 30 is fixed on the top of the supporting portion 20 attached to the first pendulum rod 16, and the other linking magnet 32 is fixed to a corresponding portion to the linking magnet 30 on the top of the supporting portion 22 attached to the second pendulum rod 18. Accordingly, the mutual magnetic force is activated between both of the linking magnets 30 and 32 to follow and link the swing of the second pendulum rod 18 to the swing of the first pendulum rod 16.

Therefore, according to the present invention, the second pendulum rod 18 or the second pendulum 14 requires no apparatus to be magnetically coupled with the clock body 10, whereby it becomes possible to obtain the double pendulum clock which is thin and small in size in spite of the double pendulum.

Figure 3:
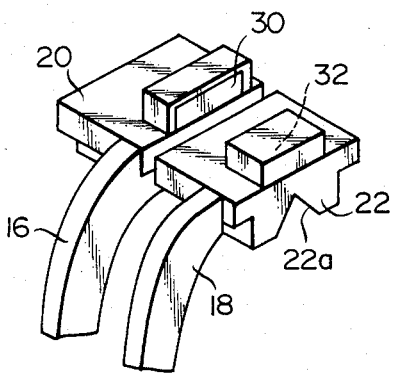
FIG. 3 is a perspective view of a principal portion showing the arrangement of a linking magnet pair in the embodiment.

In FIG. 3 shown therein is an arrangement of the above mentioned linking magnets 30 and 32 in the still state of the pendulums. Both of the magnets 30 and 32 meet in the closest manner in the still state of the pendulums. The mutual magnetic force in this state activates to start the requested linking movement.

Figure 4:
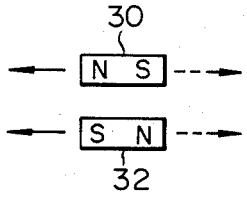
FIGS. 4 and 5 are illustrations describing the pole arrangement of the linking magnets and their mutual magnetic actions.

In the present invention, both of the magnets 30 and 32 are arranged with an optional section. As shown in FIG. 4, when they are arranged so that a pole can face the opposite pole, the attracting action of magnet produces the same phase movement on both of the pendulum rods 16 and 18. As shown by the arrow line in FIG. 4, when the primer magnet 30 moves toward the left direction, the follower magnet 32 moves to the same direction. On the contrary, when the primer magnet 30 moves to the right direction, the follower magnet 32 moves to the right as shown by the dotted line.

Figure 6:
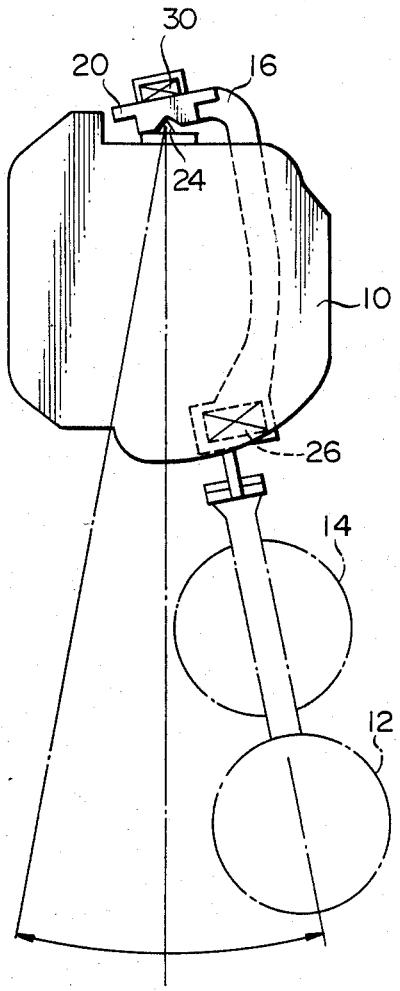
FIGS. 6 and 7 are illustrations describing the action in the swinging conditions of the embodiment.

Accordingly, the clock with such arrangement that the magnets are positioned to face the opposite pole, as shown in FIG. 4, swings the double pendulums in the same phase, as shown in FIG. 6. As evident from the Figure, both of the pendulums 12 and 14 swing in the overlapping state.

Figure 5:
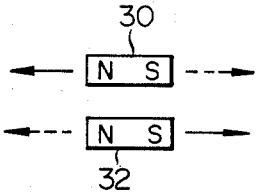
Figure 7:
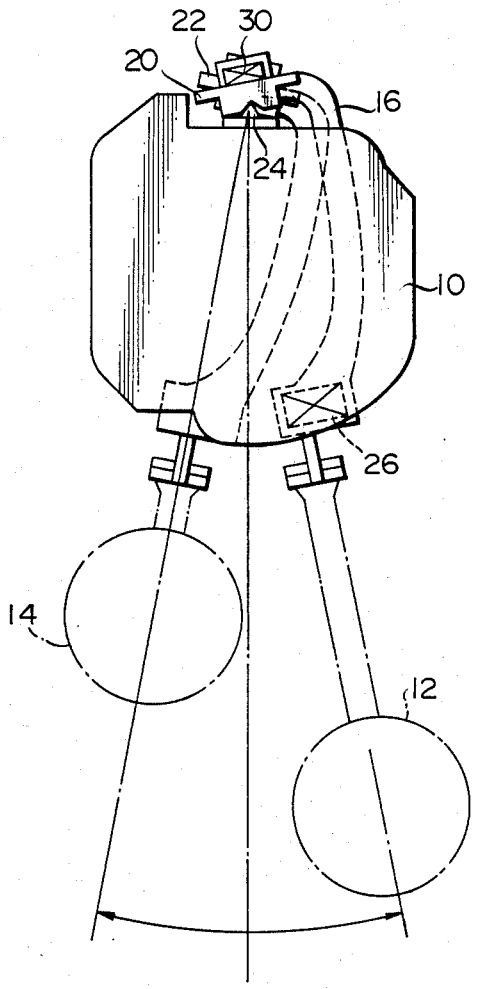

On the other hand, as shown in FIG. 5, when both of the magnets 30 and 32 are arranged so that the magnets are positioned to face the same pole towards each other, the repulsing magnet force is activated between both of the magnets 30 and 32, and both of the pendulum rods 16 and 18 swing in different directions from each other and can obtain the pendulum swinging state as is shown in FIG. 7.

As described hereinabove, according to the present invention, the first pendulum rod is electromagnetically driven by the drive coil attached to the clock body. On the other hand, the second pendulum rod is swung by the magnet coupling with the first pendulum rod, whereby the electromagnetic drive mechanism can be simplified so much that the clock can be designed to be thinner and smaller. Therefore, according to the present invention, a variety of designs can be taken effect with dynamic changes as well as optional selection in casing or outer design.

Especially, as shown in FIG. 5, the arrangement of the linking magnets 30 and 32 in the facing way with the same phase makes it possible to swing the second pendulum rod 18 in accordance as the swing of the first pendulum rod 16 by means of the repulsion magnet force produced between both of the magnets 30 and 32, and the starting characteristics of the pendulum can be highly increased since the still magnet bypass can be strongly produced in the initial still state of the pendulum.

In other words, the pole arrangement of the linking magnets 30 and 32 in a facing way with a same phase as is shown in FIG. 5 activates the repulsion magnet force between both of the mangets 30 and 32, and the repulsing action is increased to the maximum when the pendulums stand still. Therefore, the still magnet bias is produced between both of the pendulums to pull off each other in the still state of the pendulums, and the ordinary repulsing action between both of the magnets attains the self-start with an extremely small driving power applied to the drive coil 28 so that easy and smooth swinging movement of the double pendulums can be obtained as shown in FIG. 7.

Therefore, according to the present invention, as shown in FIG. 5, the pole arrangement of the linking magnets fixed to the supporting portions of the first and the second pendulum rods produce the repulsing action and the still magnet bypassing action in the still state of the pendulums so that the preferrable self-starting characteristics of the pendulums are effectively obtained without separately having a large drive force applying mechanism required for starting the pendulums.

THE SECOND EMBODIMENT

The second embodiment of the present invention will be hereinafter described. The like elements corresponding to the ones in the first embodiment are denoted with like numerals, and their description will be omitted.

As evident from the description in the first embodiment, the double pendulums in accordance with the teachings of the present invention can be swung with the same or different phase, or with an optional independent cycle. In such swinging state, there occurs a problem that a slight supporting error supporting axis direction causes in the contact between the pendulum rods or the pendulums in case of close arrangement of two pendulum rods or the pendulums respectively connected to both of them.

Figure 8:
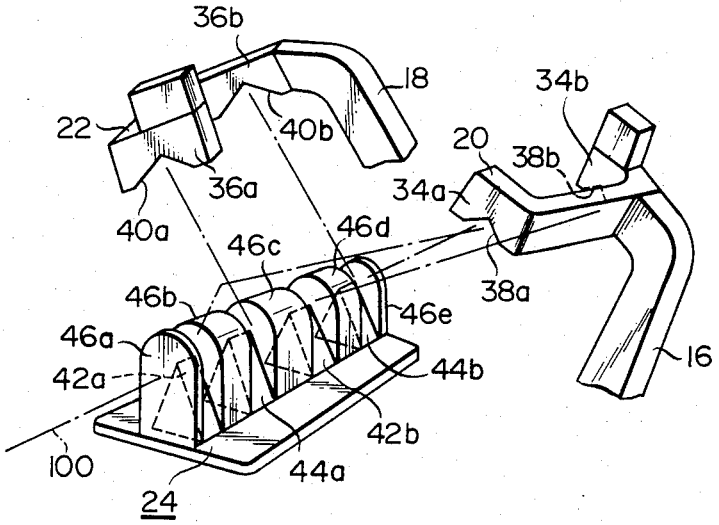
FIG. 8 is a perspective view, partly broken away, of a principal portion showing a preferred embodiment of supporting mechanism in accordance with the teachings of the present invention.
Figure 9:
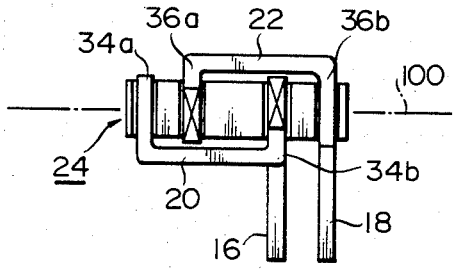
FIG. 9 is a top view of a principal portion showing the assembled state from FIG. 8.

This embodiment provides a supporting mechanism in which the pendulum rods can be closely arranged and the rocking motion can be firmly prevented. In FIGS. 8 and 9 shown therein are a perspective view, partly enlarged and broken away, of a principal portion of the supporting mechanism and a top view of the assembled state.

As previously described, the supporting portions 20 and 22 are respectively fixed on the tops of each of the pendulum rods 16 and 18. In this embodiment, both of such supporting portions 20 and 22 are provided in a channel shape on the plane, as is shown in the top view of FIG. 9, and V-shape grooves 38*a*, 38*b* and 40*a*, 40*b* are respectively formed on their lower surfaces of side wing portions 34*a*, 34*b* and 36*a*, 36*b*.

In this embodiment, therefore, both of the supporting portions 20 and 22 include respective pairs of V-shape grooves 38 and 40 with a predetermined separation. The two point support with a predetermined separation performs a stable supporting action.

In other words, the clock body 10 supporting the respective V-shape grooves 38 and 40 of the above mentioned channel shape supporting portions 20 and 22 provides a knife-edge base plate 24 which has four knife-edges 42*a*, *42b*, 44*a* and 44*b*, respectively, corresponding to the above mentioned four V-shape grooves 38*a*, 38*b* and 40*a*, 40*b*. In this embodiment, in order to determine the separate spaces between the respective knife-edges 42 and 44, there are provided partition walls 46*a*–46*e* between the respective knife-edges and on their both side. The partition walls 46 are solidly formed with the knife-edges 42 and 46. Accordingly, the supporting portions 20 and 22 supporting each of the pendulum rods 16 and 18 are regulated in their movement toward the supporting axis direction 100 and each of the pendulum rods 16 and 18 can be supported in the position with a correct axis of direction.

As shown in FIG. 9, the supporting portions 20 and 22 having the above mentioned channel shape plane are placed on the knife-edge base plate 24 so that two channel shaped figures can be geared with each other at the position and moved with a certain phase in the supporting axis direction, in other words, with a distance determined by the respective knife-edges 42 and 44, and a correct assembled state can be attained.

As evident from FIG. 9, the pendulum rods 16 and 18 can be positioned closely enough that the double pendulum clock can be designed in extremely thin and small sizes without increasing the thickness of the clock body in case the pendulum rods 16 and 18 are designed to penetrate through the clock body 10. Since the supporting portions 20 and 22 are supported by the V-grooves prepared on their side wings 34 and 36 which are arranged with a suitable distance along the supporting axis direction 100 even if the pendulum rods 16 and 18 are so closely positioned (as in shown in FIG. 9) a fall and the other movements toward the supporting axis direction 100 are regulated to an extremely small amount and a stable support can be attained.

Figure 10:
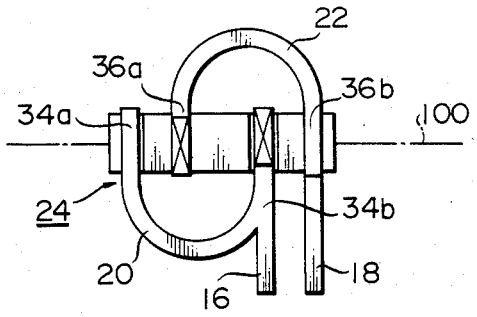
FIGS. 10 and 11 are top views of principal portions respectively showing other preferred embodiments of supporting mechanisms.
Figure 11:
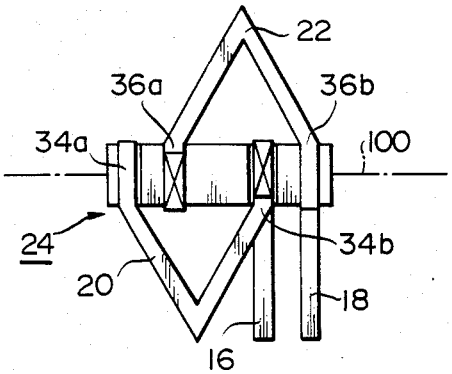

In FIGS. 10 and 11 respectively shown therein are other preferred embodiments wherein the supporting portions 20 and 22 are composed of U-shape and V-shape to provide the same effects as the embodiments hereinabove described.

In each of the embodiments heretofore described, the supporting portions are provided on the top ends of the pendulum rods and the knife-edge base plate is fixed to the clock body. However, it is also possible to provide the channel shape supporting portions having the V-shape grooves on the clock body and to attach the knife-edge base plate to the pendulum rods.

As described heretofore, according to this embodiment, since the pendulum rods are respectively supported by a pair of V-shape grooves separately arranged along a supporting axis direction, the stable support can be easily guaranteed, and the clock can be designed to be thin and small.

Accordingly, a variety of designs can be provided with dynamic changes as well as the optional selection in the casing or outer design, according to this embodiment.

THE THIRD EMBODIMENT

The third embodiment of the present invention will be hereinafter described in reference to the drawings.

According to the double pendulum clock in this embodiment, it becomes possible to have optional drawings emerge from two polarizing plates at an overlapping position of two polarizing plates which are provided on the two pendulum weights and to provide a dynamic feeling in addition to the rhythmical pendulum movements.

Figure 12:
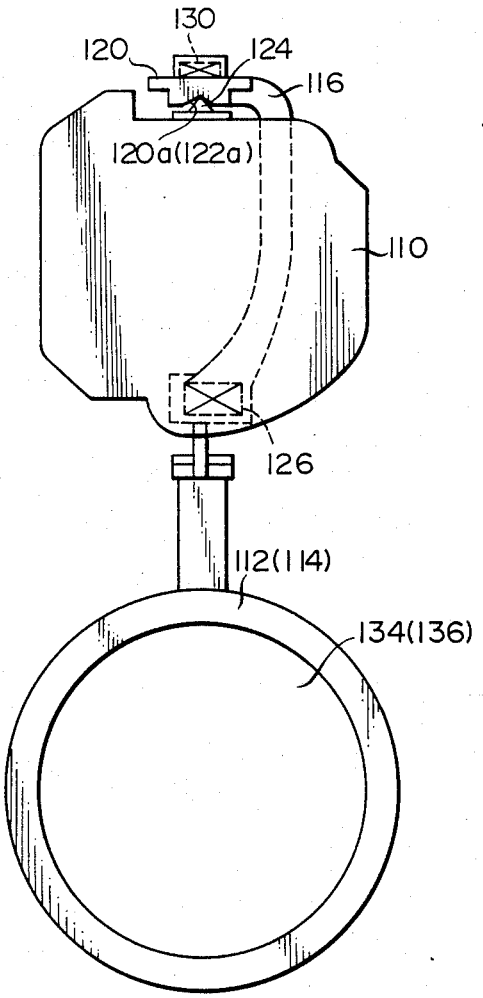
FIG. 12 is a front elevation of a principal portion showing another preferred embodiment of the pendulum clock in accordance with the teachings of the present invention.
Figure 13:
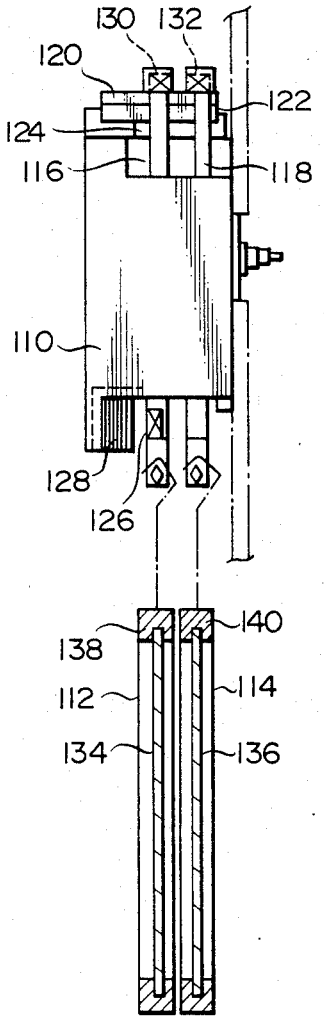
FIG. 13 is a side view of FIG. 12.
Figure 16:
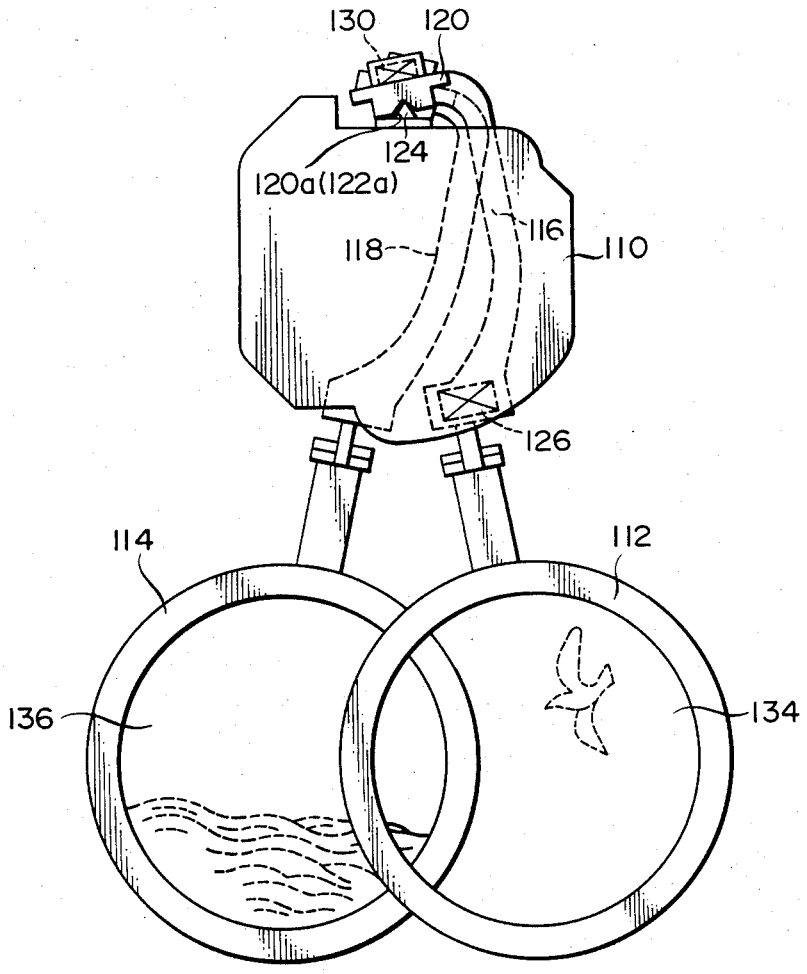
FIGS. 16, 17, 18 and 19 are illustrations of figure manifesting actions in the overlapping and departing conditions of polarizing plates used for the pendulum weights of two pendulums in accordance with the teachings of the present invention.
Figure 17:
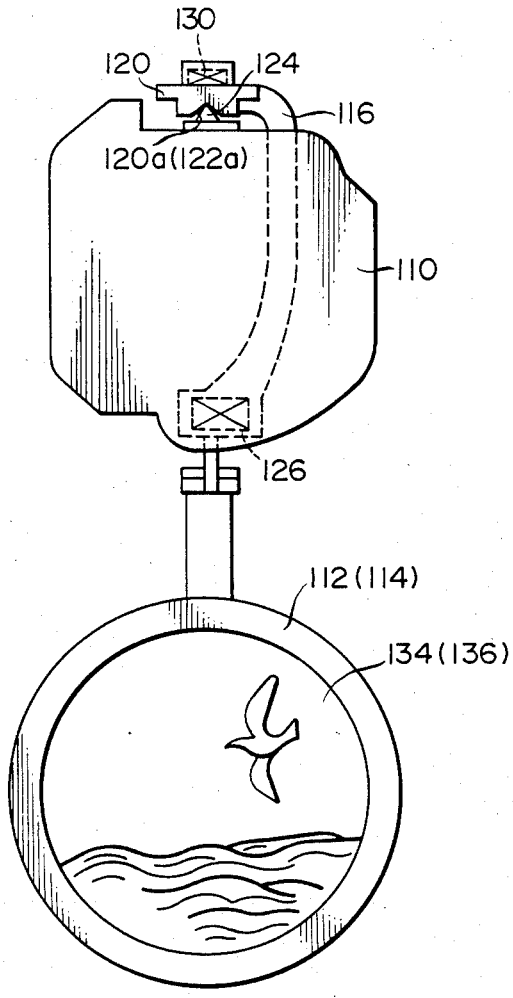
Figure 18:
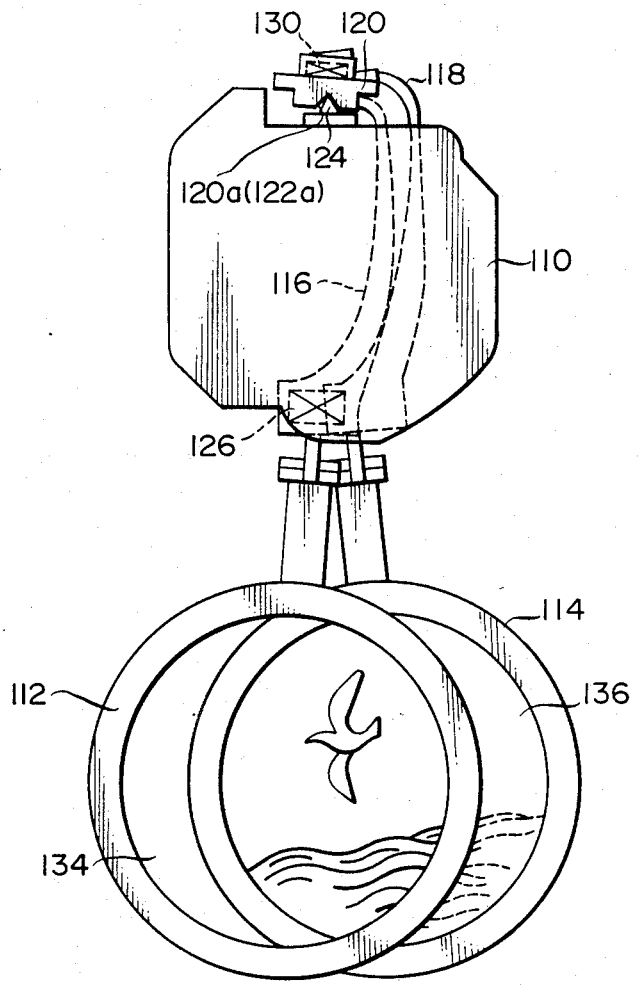
Figure 19:
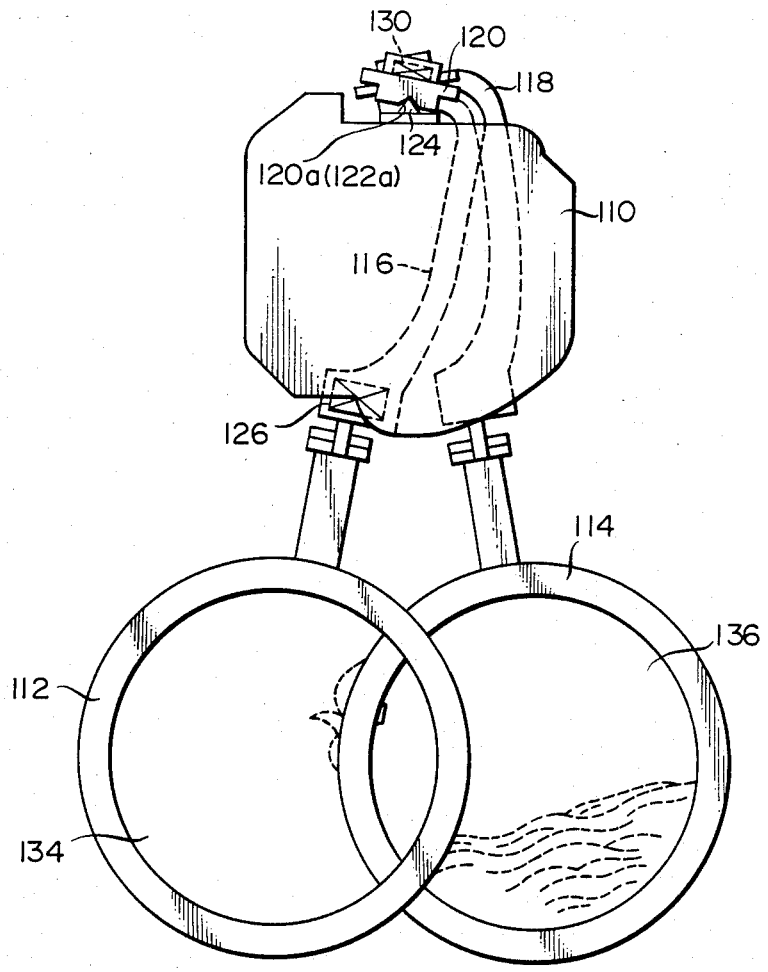

In FIGS. 12 and 13 shown therein is the third preferred embodiment of the double pendulum clock in the present invention. The clock body 110 consists of a crystal clock and the double pendulums 112 and 114 are driven as ornamental pendulums quite separately from the time counting action of the clock body.

In this embodiment, the two pendulums 112 and 114 consist of the same length and each of them are connected to the pendulum rods 116 and 118, each of which is swingingly supported by the clock body 110. The pendulum rods 116 and 118 are fixingly provided supporting portions 120 and 122 on their top ends respectively and the V-shape grooves 120*a* and 122*a* are made on the lower surface of the supporting portions 120 and 122. The engagement of the V-shape grooves 120*a* and 122*a* with the knife-edge 124 fixed on the clock body 110 swingingly supports both of the pendulum rods 116 and 118 on the clock body 110.

In order to drive and swing the above mentioned pendulum rod 116 at a predetermined cycle the drive magnet 126 is attached on the pendulum rod 116, and the drive coil 128 is fixed at a predetermined position on the clock body 110 so that the drive coil 128 can face the above mentioned drive magnet 126. Therefore, the magnet coupling between the drive magnet 126 and the drive coil 128 drives and swings the pendulum rod 116 or the pendulum 112.

In this embodiment, electromagnetic driving action between the drive magnet 126 and the drive coil 128 is performed with the pendulum rod 116 or the pendulum 112. With regard to the pendulum rod 118 or the pendulum 114 the movement of the pendulum rod 118 linked to the movement of the pendulum rod 116.

In other words, the linking magnet 130 is fixed on the top of the supporting portion 120 attached to the pendulum rod 116, and the other linking magnet 132 is fixed to the corresponding position to the linking magnet 130 on the top of the supporting portion 122 attached to the pendulum rod 118. Accordingly, the mutual magnetic force is activated between both of the linking magnets 130 and 132 to follow and link the swing of the pendulum rod 118 to the swing of the pendulum rod 116.

Figure 14:
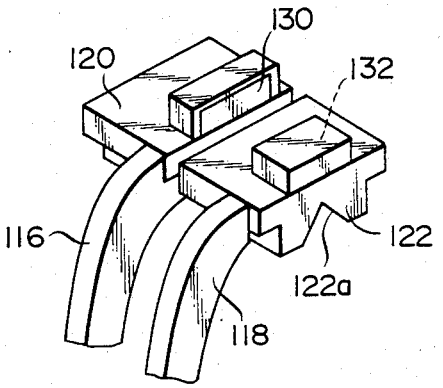
FIG. 14 is a perspective view of a principal portion showing the arrangement of the linking magnet pair in the embodiment.

In FIG. 14 shown therein is an arrangement of the above mentioned linking magnets 130 and 132 in the still state of the pendulums. Both of the magnets 130 and 132 meet in the closest manner in the still state of the pendulums. The mutual magnetic force in this state activates to start the requested linking movement.

Figure 15:
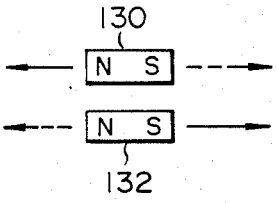
FIG. 15 is an illustration describing the pole arrangement of the linking magnets and their mutual magnetic actions.

In this embodiment, as shown in FIG. 15, when both of the magnets 130 and 132 are arranged so that the magnets are positioned to face the same pole toward each other, the repulsing magnetic force activates between both of the magnets 130 and 132, and both of the pendulum rods 116 and 118 swing in different directions from each other.

This embodiment is characterized in that the pendulum weights of the pendulum 112 and 114 are composed of the polarized plates 134 and 136, each of which is provided with a requested figure of pictures, letters, marks, or the like (hereinafter described as the figure) so that the figure can repeated appear and disappear in accordance with the overlapping position on the swinging locus of the two pendulums.

In other words, the pendulums 112 and 114 are respectively composed of circular frames 138 and 140 and polarizing plates 134 and 136 supported by the circular frames 138 and 140. As the mutual magnetic force between the linking magnets 130 and 132 drives to swing the pendulums 112 and 114, to overlap both of the pendulums, and to move away from each other, the figures drawn on both of the pendulums naturally emerge out. Right here, the polarizing plates 134 and 135 are of equal polarizing characteristics from each other and the plates of different polarizing characteristics are built into the figure positions of the respective polarizing plates 134 and 136 so that the requested figure can be composed at their overlapping position.

In FIGS. 16, 17, 18 and 19 shown therein is the appearance of the figure in the overlapping and departing time of the pendulums 112 and 114. As two pendulums move from the position in FIG. 16 to the one in FIG. 19, the figure of a bird provided on the polarizing plate 112 and the scene of sea provided on the polarizing plate 114 gradually appear and form to be a composed picture when these two polarizing plates 112 and 114 are completely overlapped. While the pendulums are swinging, the bird and the sea (waves) can be seen as if they are moveing.

In this embodiment, the pendulums 112 and 114 are composed of circular frames, but it is also possible to make the frames in some other shape such as a rectangle, a diamond shape, or the like in accordance with the shape of the figure.

Figure 20:
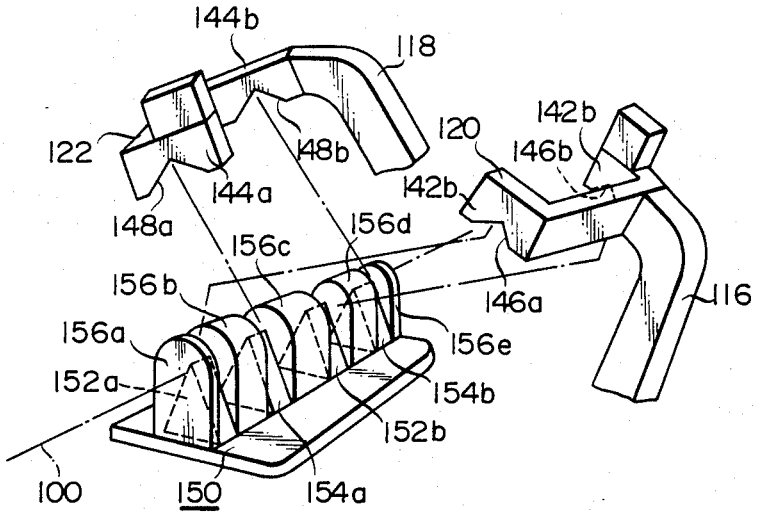
FIG. 20 is a perspective view, partly broken away, of a principal portion of preferred embodiment of the support mechanism in accordance with the teachings of the present invention.
Figure 21:
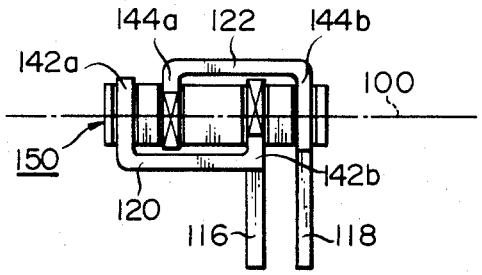
FIG. 21 is a top view of a principal portion showing the assembled state from FIG. 20.

In FIGS. 20 and 21 shown therein are the other preferred embodiments of the pendulum rod supporting portions of the pendulum clock. The like elements corresponding to the embodiments described hereinabove are denoted with like numerals and their descriptions will be omitted.

Although in the swinging state of the pendulums there occurs a problem that the slight supporting error in the supporting axis direction causes contact between the pendulum rods 116 and 118 of a pendulums in case of close arrangement of two pendulum rods or the pendulums respectively connected to both of them, this embodiment provides a supporting mechanism in which the pendulum rods can be closely arranged as well as the rocking motion can be firmly prevented. In FIGS. 20 and 21 respectively shown therein are a perspective view, partly enlarged and broken away, of a principal portion of the supporting mechanism and a top view of the assembled state.

As previously described, the supporting portions 120 and 122 are respectively fixed on the tops of each of the pendulum rods 116 and 118. In this embodiment, both of such supporting portions 120 and 122 are provided in channel shape on the plane as is shown in the top view of FIG. 21, and V-shape grooves 146*a*, 146*b* and 148*a*, 148*b* are respectively formed on their lower planes of side wing portions 142*a*, 142*b* and 144*a*, 144*b*.

In this embodiment, therefore, both of the supporting portions 120 and 122 include respective pairs of V-shape grooves 146 and 148 with a predetermined separation. The two point support with a certain distance separation performs a stable supporting operation.

In other words, the clock body 110 supporting the respective V-shape grooves 146 and 148 of the above mentioned channel shape supporting portions 120 and 122 is provided a knife-edge base plate 150 which has four knife-edges 152*a*, 152*b*, 154*a* and 154*b* respectively corresponding to the above mentioned four V-shape grooves 146*a*, 146*b*, 148*a* and 148*b*. In this embodiment, in order to determine the separate spaces between the respective knife-edges 152 and 154, there are provided partition walls 156*a*–156*e* between the respective knife-edges and on their both sides. The partition walls 156 are solidly formed with the knife-edges 152 and 154. Accordingly, the supporting portions 120 and 122 supporting each of the pendulum rods 116 and 118 are regulated in their movement toward the supporting axis direction 100 and each of the pendulum rods 116 and 118 can be supported in the position with correct axis of direction.

As shown in FIG. 21 the supporting portions 120 and 122 having the above mentioned channel shape plane are placed on the knife-edge base plate 150 so that two channel shaped figures can be geared with each other at the position moved with a certain phase to the supporting axis direction 100, in other words, with a certain distance determined by the respective knife-edges 152 and 154, and correct assembled state can be attained.

As evident from FIG. 21, the pendulum rod 116 and 118 can be positioned closely enough that the double pendulum clock can be designed in extremely thin and small sizes without increasing the thickness of the clock body in case the pendulum rods 116 and 118 are designed to penetrate through the clock body 110. Since the supporting portions 120 and 122 are supported by the V-grooves provided on their side wings 142 and 144 which are arranged with a suitable distance along the supporting axis direction 100 even if the pendulum rods 116 and 118 are closely positioned, as is shown in FIG. 21, a fall and the other movements toward the supporting axis direction 100 are regulated to an extremely small amount and a stable support can be attained.

Accordingly, the supporting error to the supporting axis direction does not occur and the complete figure appearance can be enjoyed at the time of overlap of the polarizing plates 134 and 136 as mentioned above. Thus, it is understood that the ornamental effect of the clock can be further increased in its exterior appearance.

As described heretofore, according to this embodiment, a requested figure can be emerged by means of overlapping the polarizing plates provided on the pendulum weights of two pendulums, and a clock with original dynamic design can be easily obtained.

What is claimed is:

1. A double pendulum clock comprising:

a first pendulum rod swingingly pivoted on a clock body and connected to a first pendulum;

a drive magnet coupled to said first pendulum rod;

a drive coil provided on the clock body to drive the first pendulum by means of electromagnetic coupling with said drive magnet;

a second pendulum rod swingingly pivoted on the clock body and connected to a second pendulum;

a supporting mechanism for said pendulum rods consisting of channel shaped supporting portions shaped like channel iron sections having V-grooves on their side wing walls, which are arranged on the either one of the top ends of said two pendulum rods or the clock body, and a knife-edge base plate in order to swingingly support said two supporting portions along the common supporting axis, which is fixed on the other one, wherein said supporting portions are placed on said knife-edge base plate so that said two channel shape supporting portions can be geared with each other at a different phase along the supporting axis direction, whereby two pendulum rods can be supported by the clock body closely and stabily to each other; and linking magnets provided on said first and second pendulum rods at positions facing said first pendulum rod and said second pendulum rod, respectively and for swinging said second pendulum rod in accordance with the swing of said first pendulum rod by means of mutual magnetic force between linking magnets.

2. A double pendulum clock according to claim 1, wherein said two pendulums have polarizing plates in their pendulum weights and a requested figure is provided at one polarizing plate at least so that appearance and disappearance of the figure can be repeated in accordance with the overlapping position of said two pendulums.

* * * * *